United States Patent [19]

Collin

[11] Patent Number: 4,835,906

[45] Date of Patent: Jun. 6, 1989

[54] SECURITY GRILL FOR WINDOW OPENING

[76] Inventor: Pierre Collin, 286 Pincourt, Neufchatel, Quebec, Canada, G2B 2E4

[21] Appl. No.: 95,890

[22] Filed: Sep. 14, 1987

[51] Int. Cl.[4] ..... E06B 3/68

[52] U.S. Cl. ..... 49/57

[58] Field of Search ..... 49/57, 50, 463, 62

[56] References Cited

U.S. PATENT DOCUMENTS

| | | | |
|---|---|---|---|
| 4,283,881 | 8/1981 | Moore et al. | 49/57 X |
| 4,478,002 | 10/1984 | English | 49/57 |
| 4,575,965 | 3/1986 | Iversen | 49/57 X |
| 4,653,226 | 3/1987 | Woodrow | 49/57 |

*Primary Examiner*—Philip C. Kannan

[57] ABSTRACT

A security grill structure for preventing entrance through a wall opening. The grill structure comprises a metal peripheral retention frame securable in the wall opening. The frame has opposed parallel channel members interconnected by opposed transverse bars. A lock is provided in one of the channel members and is operable from an inside face of the retention frame. A grill engaging element is secured to each of the transverse bars. A removably engageable metal grill is receivable in an opening defined by the peripheral retention frame and is engageable by the lock, the other channel member and the grill engaging element.

10 Claims, 2 Drawing Sheets

SECURITY GRILL FOR WINDOW OPENING

BACKGROUND OF INVENTION

1. Field of the Invention

The present invention relates to an improved metal security grill structure to prevent entrance through a wall opening such as a window or door opening and particularly to a grill which is rigidly secured within a frame and easily removable therefrom whilst providing a decorative and aesthetically appealing design.

2. Description of the Prior Art

Various types of grill structures for securement in window or door openings are known. Many of such structures are bolted to the frame and are difficult to remove therefrom as they require special tools, such as wrenches or screwdrivers. The removal of such frames is also time-consuming. Still further, these frames are bulky and heavy, difficult to install, and are not aesthetically appealing. For example, reference is made to Canadian Pat. No. 1,182,344 which relates to an antitheft window guard which is secured to a window frame by a plurality of fastening elements such as screws. Another disadvantage of such prior art structures is that they provide access to the fastening element, from the outside, whether positioned on the inner periphery of the window frame or on the back side thereof as the fastener locations are visible.

SUMMARY OF INVENTION

It is a feature of the present invention to provide a security grill structure which substantially overcomes all of the above-mentioned disadvantages of the prior art.

Another feature of the present invention is to provide a security grill structure which comprises a retention frame and a removably securable grill, with the retention frame being secured by fasteners which are not accessible from the outside of the frame when the grill is received within the frame.

Another feature of the present invention is to provide a security grill wherein the grill is easily removable and does not require any tools for the removal thereof.

Another feature of the present invention is to provide a security grill which is lightweight, aesthetically pleasing, and which is easy to assemble and disassemble.

Another feature of the present invention is to provide a security grill structure wherein the grill is secured on all of its opposed sides and wherein the grill may be removed from its many securements by simply unlocking a single lock element.

Another feature of the present invention is to provide a security grill structure having a retention frame which is easily securable to a window or door opening and further having a grill structure comprised of an aesthetically pleasing lattice structure.

According to the above features, from a broad aspect, the present invention provides a security grill structure for preventing entrance through a wall opening. The grill structure comprises a metal peripheral retention frame having means for removably securing same in a wall opening. The frame has opposed parallel channel members interconnected by opposed transverse bars. A lock is provided in one of the channel members and is operable from an inside face of the retention frame. Grill engaging means is secured to each of the transverse bars. A removably engageable metal grill is receivable in an opening defined by the peripheral retention frame and engageable by the lock, the other channel member and the grill engaging means.

BRIEF DESCRIPTION OF DRAWINGS

A preferred embodiment of the present invention will now be described with reference to the example thereof as illustrated in the accompanying drawings, in which.

DESCRIPTION OF PREFERRED EMBODIMENTS

Figure 1:
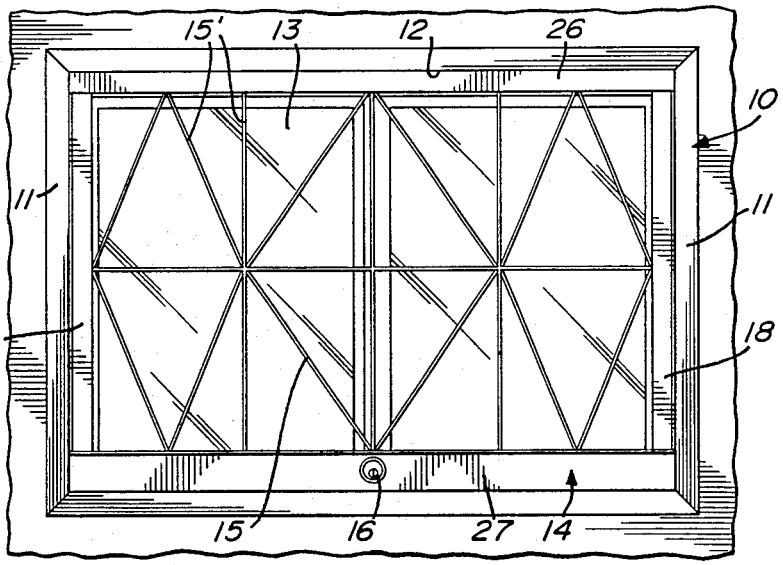
FIG. 1 is a plan view showing the security grill structure of the present invention as secured within a window opening.

Referring now to the drawings, and particularly to FIG. 1, there is shown generally at 10 the security grill structure of the present invention as secured within the window frame 11 of a window opening 12 having two or more window panes 13 therein. The security grill comprises a retention frame 14 and a removably engageable grill 15. A lock 16 secures the grill 15 within the frame 14.

Figure 2:
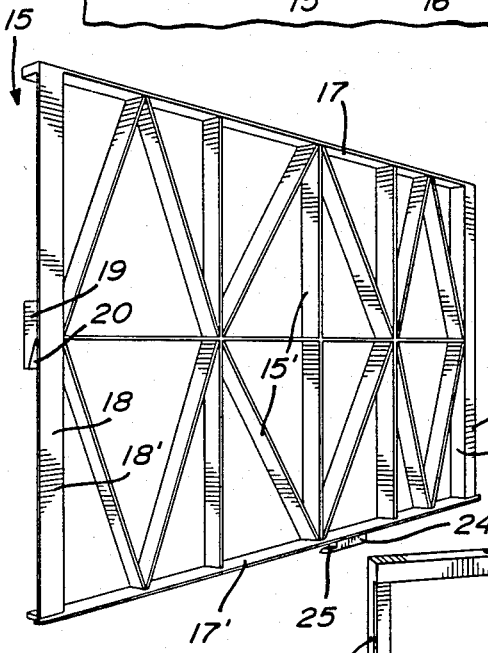
FIG. 2 is a perspective view of the grill.
Figure 3:
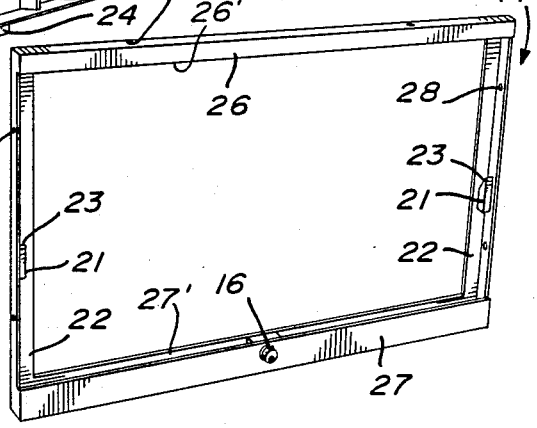
FIG. 3 is a perspective view of the retention frame.

Referring now additionally to FIGS. 2 and 3, there is shown the construction of the frame 14 and grill 15. As herein shown, the grill and frame are of rectangular configuration. The grill has a peripheral structural frame comprised of a pair of horizontal flat metal bars 17, such as steel or aluminum and disposed parallel to one another and a pair of opposed vertical structural arms 18. The structural arms 18 are right angle channel members with the V openings of the members facing outwardly of the grill whereby the grill has an inner vertical flat wall 18' and an inner transverse flat wall 18''. A lock engaging member, in the form of a wedge 19, is secured to the flat wall 18'' at a predetermined location. The wedge member has an angulated surface 20 disposed downwardly whereby to mate with a wedge 21 associated with each of the opposed transverse right angle members 22 of the retention frame 14. The wedge of the retention frame has an angulated surface 23 which extends upwardly whereby the surfaces 20 and 23 will align themselves in mating relationship when the grill is positioned within the frame, as will be described later with reference to FIGS. 5 and 6. These wedges constitute grill and frame engaging means.

As shown in FIG. 2, the bottom flat bar 17' is provided with a lock engaging member 24 in the form of a block having a steel flange 25 which is spaced from the underside of the flat bar 17' for engagement with a dead bolt member of the lock 16, as will be described later.

As shown in FIG. 3, the retention frame has opposed parallel channel members, namely a top channel member 26 and a bottom channel member 27, interconnected by the opposed transverse right angle channel members 22. Each channel member has a mouth opening 26' and 27' respectively. The distance between the mouth openings of the channel members is smaller than the distance between the flat bars 17 and 17' of the grill 15. Thus, the grill may be engaged with the top flat bar 17 located internally of the top channel member 26 with the bottom flat bar 17' secured to the bottom channel 27 through the steel flange 25 and the lock bolt of the lock 16. As shown in FIG. 3, the right angle channel members 22 have their V openings facing inwardly.

In order to secure the retention frame 14 within the window opening 12, there is provided at least one fastener receiving bore 28 in each of the opposed right angle channel members 22 and opposed channel members 26 and 27. Thus, the frame can be secured within the inside ledge of the window frame 11, as shown in FIG. 1.

Figure 6:
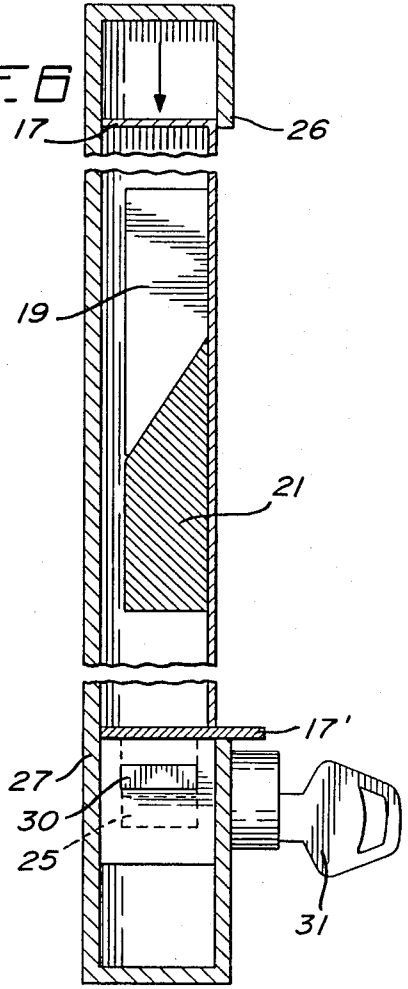
FIGS. 5 and 6 are section views showing the installation of the metal grill within the retention frame.
Figure 5:
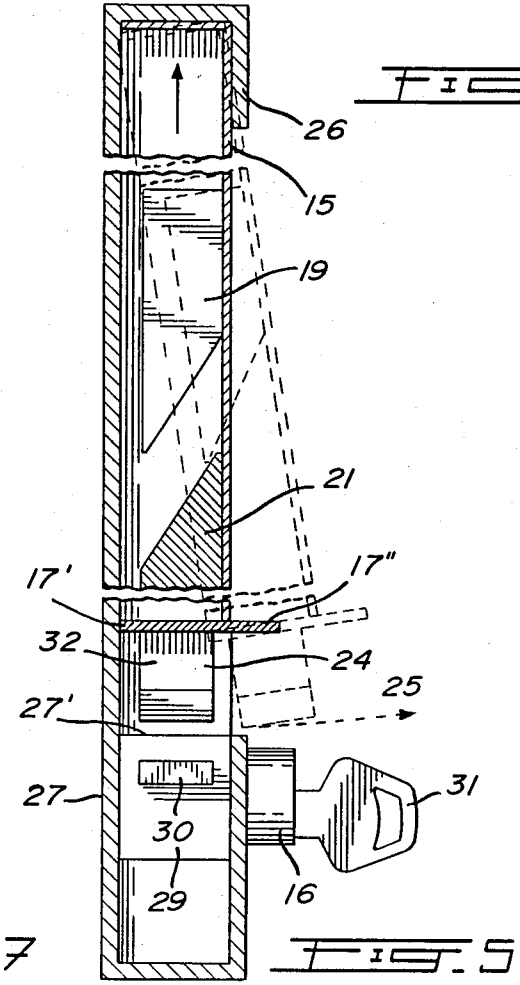
Figure 4:
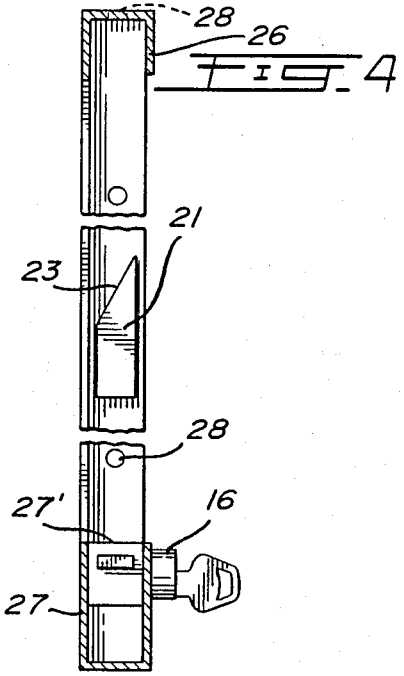
FIG. 4 is a section view of the retention frame.
Figure 7:
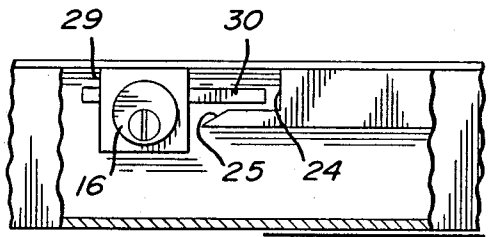
FIG. 7 is a cut-out view of the lock showing its engagement with the grill.

Referring now additionally to FIGS. 4 to 6, it can be seen that in order to secure the grill 15 within the retention frame 14, it is firstly necessary (see FIG. 5) to insert the top end, i.e. the top flat bar 17, of the grill within the top channel 26 of the frame. This permits the grill to be positioned within the plane of the frame with the wedge 19 of the grill extending above the wedge 21 of the frame. Also, the locking flange 25 protruding from the bottom flat bar 17' lies above the top opening 27' of the bottom channel 27. As is clearly shown in FIGS. 5 and 6, this bottom flat bar 17' is provided with a lip portion 17'' whereby the bottom bar 17' will rest across the opening 27' of the bottom channel member 27 of the retention frame 14. With the grill thus positioned in the frame, the grill is then lowered by gravity, as shown in FIG. 6, until the bottom flange 17' fits on the top of the bottom channel member 27. The angulated surfaces of both wedges 19 and 21 are then positioned in mating engagement and prevent the grill from being pushed out of the plane of the frame. Also, because the grill has a longer dimension widthwise than the distance between the opposed channel members 26 and 27 of the frame, the top flat bar 17 is retained within the top channel member 26 and also provides engagement of the grill along its upper edges as well as the side edges. In this position, and as shown in FIG. 7, the flange 25 of the lock engaging member is disposed beneath a dead bolt member 30 associated with the lock cylinder 29 of the lock 16 and upon activation thereof by a key 31, or other lock activating means, the dead bolt will move in the space 32 above the flange 25 and prevent the frame from moving upwardly into the top channel member 26. Accordingly, the bottom wall of the grill is also locked.

As can be seen, all sides of the grill frame are locked within the retention frame 14. Also, because the right angle channels of the frame and the grill have their V openings facing one another, when the grill is engaged within the frame these form a pair of opposed hollow structural posts with the wedges being disposed internally of the hollow structural posts and not visible to the eye.

Accordingly, with such a structure, all of the attachments are concealed and an alleged intruder would not know how, how many, or where the connections are made between the frame and the wall opening and between the frame and the grill.

As shown in FIGS. 1 and 2, the inner lattice structural frame 15' of the grill is formed by flat metal bars disposed with their planar axes extending in the same plane as the opposed flat bars 17 and 17' and can have a variety of designs and patterns which are pleasing to the eye. The grill and the frame are also colored to match the window frame or any other desired color. The lock 17 may be a key operated cylinder lock or could be an electrically operated lock.

It can be appreciated that with the present structural grill construction, the grill element 15 can be easily removed and installed within the frame 14. All that it is necessary to do is to unlock the lock 16 and push the grill upwardly within the top channel 17 and then pull the bottom of the grill inwardly and downwardly. The re-installation comprises moving the top flat bar of the grill 15 within the top channel 26 and placing the grill within the plane of the frame, and then letting it drop into position and re-locking it with the key operated lock 16.

It is within the ambit of the present invention to provide any obvious modifications of the example of the preferred embodiment described herein provided that such modifications fall within the scope of the appended claims.

I claim:

1. A security grill structure for preventing entrance through a wall opening, said grill structure comprising a metal peripheral retention frame having means for immovably securing same in a wall opening, said frame having opposed parallel channel members interconnected by opposed transverse bars, a lock in one of said channel members operable from an inside face of said retention frame, grill engaging means secured to each of said transverse bars; and a removably engageable metal grill receivable in an opening defined by said peripheral retention frame and engageable by said lock, said other channel member and said grill engaging means.

2. A security grill as claimed in claim 1, wherein said grill has a rectangular peripheral structural frame and an inner lattice structural frame, and frame engaging means secured to opposed peripheral structural arms of said peripheral frame associated with said opposed transverse bars of said retention frame, and a lock engaging member secured to one of a pair of further transverse peripheral structural arms and associated with said channel member having said lock for engagement thereby.

3. A security grill as claimed in claim 2, wherein said grill engaging means and frame engaging means are wedges each having an angulated surface disposed to mate, the wedges of said retention frame mating with the wedges of said grill to removably interconnect said grill in said frame.

4. A security grill as claimed in claim 3, wherein the outer peripheral structural arm of said pair of further transverse peripheral structural arms is held captive in said channel member opposed to said channel member having said lock, the distance between said opposed parallel channel members being smaller than the distance across said further transverse peripheral structural arms.

5. A security grill as claimed in claim 3, wherein said means for immovably securing said retention frame in said wall opening is constituted by a fastener receiving bore in at least said opposed channels or transverse bars for receiving fastener elements therein.

6. A security grill as claimed in claim 5, wherein at least one of said fastener receiving bores is provided in each of said opposed channels and said opposed transverse bars.

7. A security grill as claimed in claim 3, wherein said opposed parallel channel members are of U-shaped cross-section and have their open ends facing one another, said one of said pair of further transverse peripheral structural arms having said lock engaging member further having a flange wall dimensioned to rest across said opening of said U-shaped channel having said lock, said lock engaging member being a steel flange spaced from an underside of said flange wall, said lock activating a dead bolt member in a locking space between said flange wall and said steel flange.

8. A security grill as claimed in claim 3, wherein said channel members are horizontally disposed members of U-shaped cross-section having their open ends facing one another, said opposed transverse bars extending vertically and constituted by right angle members having their V openings facing inwardly of said frame in the direction of said lock, said further transverse peripheral structural arms of said grill being vertical arms formed by right angle members having their V openings facing outwardly, said grill when received in said frame defining a pair of opposed hollow structural posts by said juxtapositioned right angle members of said frame and said grill with said wedges in mating relationship internally of said hollow structural posts.

9. A structural grill as claimed in claim 8, wherein said inner lattice structural frame is constituted by a pattern of flat metal bars welded to one another and to said grill structural frame.

10. A structural grill as claimed in claim 9, wherein said lock is operated mechanically, said wall opening being a window or door opening.

* * * * *